United States Patent [19]

Baustert et al.

[11] Patent Number: 4,529,449

[45] Date of Patent: Jul. 16, 1985

[54] METHOD FOR REDUCING THE AMOUNT OF PARTICLES WHICH BECOME AIRBORNE DURING EITHER OR BOTH THE DISMANTLING AND MOVING OF STRUCTURES

[75] Inventors: Steve Baustert, Kingfisher; Ivan L. Denny, Edmond, both of Okla.

[73] Assignee: Kerr-McGee Chemical Corporation, Oklahoma City, Okla.

[21] Appl. No.: 403,418

[22] Filed: Jul. 30, 1982

[51] Int. Cl.[3] ..... B08B 7/00

[52] U.S. Cl. ..... 134/4; 252/626

[58] Field of Search ..... 299/12; 134/25.1, 4, 134/36, 42; 55/87; 252/625, 626

[56] References Cited

U.S. PATENT DOCUMENTS

| | | | |
|---|---|---|---|
| 3,488,219 | 1/1970 | Moroni | 134/4 |
| 3,757,491 | 9/1973 | Gourdine | 299/12 |
| 4,000,992 | 1/1977 | Cole, Jr. | 55/87 |
| 4,400,220 | 8/1983 | Cole, Jr. | 134/25.1 |

FOREIGN PATENT DOCUMENTS

| | | | |
|---|---|---|---|
| 602406 | 5/1948 | United Kingdom | 299/12 |

OTHER PUBLICATIONS

"Decommissioning of Nuclear Facilities: A Review of Status", Published: United Kingdom Atomic Energy Authority; Article from *Atomic Energy Review*, vol. 12, No. 1, 1974 by Bainbridge et al.

"The Use of Urethane Foam in the Decontamination and Decommissioning of Nuclear Facilities" by R. E. Hermetz, MLM-2853, DOE Inter. Decommissioning Symposium, Seattle, Wash., U.S.A., Oct. 10, 1982.

"The Use of Urethane Foam in Preparing for Decontamination and Decom. of Radioactive Facilities" by R. E. Hermitz, MLM-2797, Urethane Foam Expo-6, Orlando, Fla., U.S.A., Mar. 16, 1981.

*Decontamination and Decommissioning of Nuclear Facilities*, by T. S. LaGuardia, edited by Marilyn M. Osterhout, 1980 Plenum Press, New York, p. 438.

*Primary Examiner*—S. Leon Bashore
*Assistant Examiner*—Michael K. Boyer
*Attorney, Agent, or Firm*—William G. Addison; John P. Ward

[57] ABSTRACT

A method for reducing the amount of particles which become airborne during either or both the dismantling and moving of structures wherein a foam is sprayed on the structures prior to either or both the dismantling and moving of such structures.

11 Claims, 5 Drawing Figures

METHOD FOR REDUCING THE AMOUNT OF PARTICLES WHICH BECOME AIRBORNE DURING EITHER OR BOTH THE DISMANTLING AND MOVING OF STRUCTURES

BACKGROUND OF THE INVENTION

Field of the Invention

The present invention generally relates to methods for controlling the emission of airborne particles generated during either or both the dismantling and moving of structures and, more particularly, but not by way of limitation, to methods for reducing the emission of airborne particles generated during either or both the dismantling and moving of structures by spraying the structures with a foam prior to either or both the dismantling and moving of such structures.

DESCRIPTION OF THE PREFERRED EMBODIMENT

For various reasons, it is desirable to remove or dismantle certain buildings so the land can be reclaimed for other uses, such as, for example, the erection of a new building. Initially, readily removable items are removed from the building and, then, certain portions of the building, such as windows, doors and plumbing fixtures, are dismantled and removed from the building site, leaving generally only the wall structures of the building standing. Depending on the type of roof structure and the particular dismantling procedure being employed, the roof also is sometimes dismantled and removed prior to dismantling the remaining wall structures.

After the building has been dismantled to the extent where generally only the wall structures remain standing, the wall structures, then, are dismantled. In dismantling the wall structures, explosives sometimes are utilized to collapse the wall structures and, in some other instances, relatively heavy equipment is utilized to forcibly engage and collapse portions of the wall structure until the entire wall structure substantially has been dismantled. In either instance, the dismantling of the wall structures results in the formation of relatively large volumes of airborne particles which escape into the atmosphere as dust. In many instances it is desirable or essential to control the volume or amount of dust escaping into the atmosphere during the dismantling of wall structures, such as, for example, instances where the wall structures to be dismantled are located in a relatively densely populated area, or where the wall structures may be contaminated by way of exposure to radioactive materials or other noxious substances.

Figure 1:
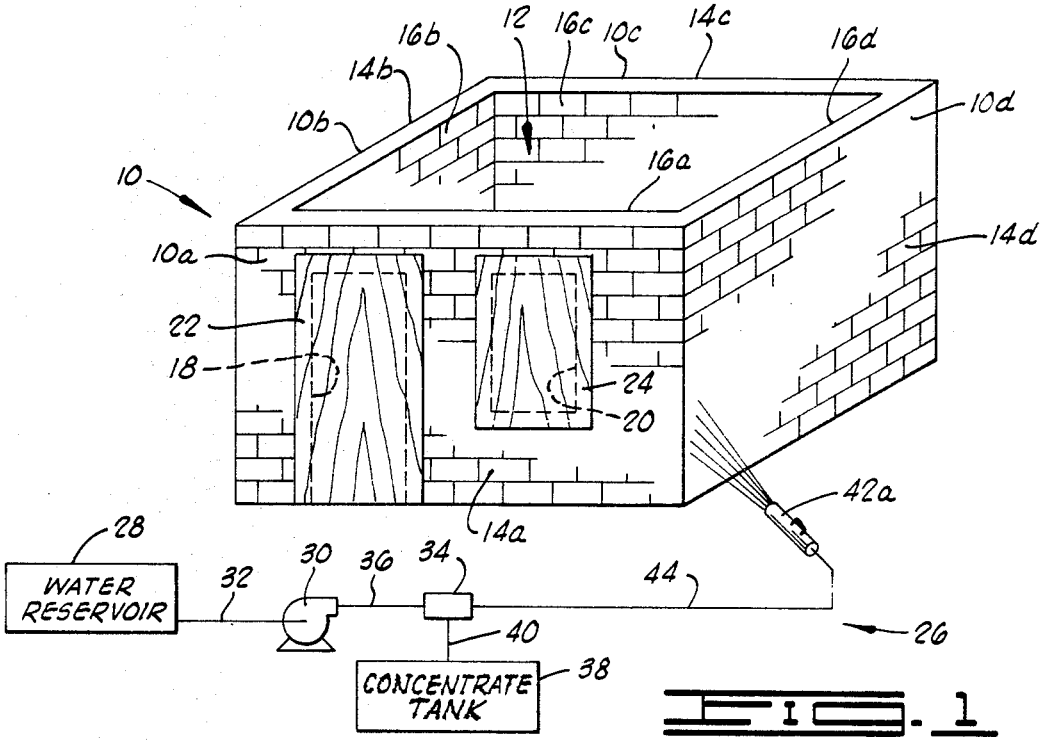
FIG. 1 is a diagrammatic view of wall structures connected together to enclose a portion of a space and a schematic, diagrammatic view showing a spray apparatus being used to spray foam on the sides of wall structures during one aspect of the method of the present invention.
Figure 2:
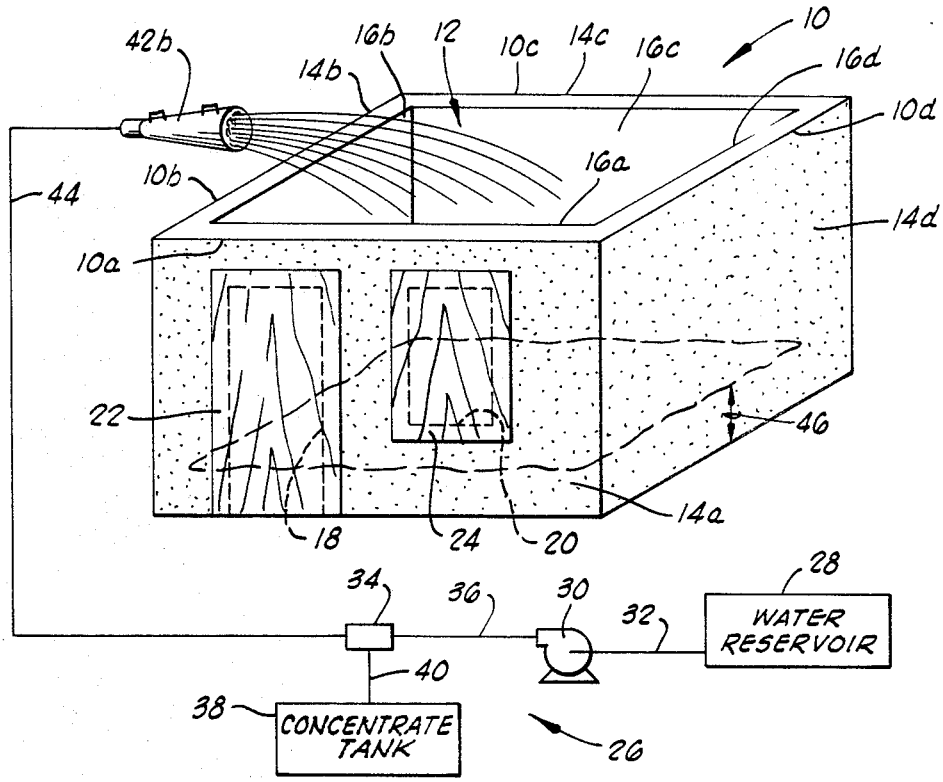
FIG. 2 is a view of the wall structures and spray apparatus of FIG. 1, the spray apparatus being modified for spraying foam into a reservoir during one other aspect of the method of the present invention.

Diagrammatically shown in FIGS. 1 and 2 is a building which has been dismantled to the point where only the wall structures remain standing, the wall structures being designated in FIGS. 1 and 2 by the general reference numeral 10 and the four individual wall structures being designated in FIGS. 1 and 2 by the reference numerals 10*a*, 10*b*, 10*c* and 10*d*, respectively. Each of the wall structures 10 generally are constructed of a plurality of concrete blocks or bricks which are secured in an assembled position by mortar in a manner well known in the art. Each wall structure 10 has an outside side 14 and an inside side 16, the individual sides 14 being designated by the reference numerals 14*a*, 14*b*, 14*c* and 14*d*, respectively, and the individual sides 16 being designated by the reference numerals 16*a*, 16*b*, 16*c* and 16*d*, respectively. As shown in FIGS. 1 and 2, the wall structures 10 are connected together in a generally rectangular shape and generally surround and substantially enclose a space 12.

Buildings usually have various openings formed through the wall structures for doors and windows, for example. As shown in FIGS. 1 and 2, a door opening 18 is formed in the wall structures 10*a* and a window opening 20 is formed in the wall structures 10*a*. In a building structure, it would not be unusual to have more than one door opening and a plurality of window openings. The single door opening 18 and the single window opening 20 have been shown in FIGS. 1 and 2 solely for the purpose of describing the method of the present invention.

As shown in FIGS. 1 and 2, the door opening 18 substantially has been covered with a panel 22 and the window opening 20 substantially has been covered with a panel 24. The panels 22 and 24 are connected to the wall structure 10*a*.

A spray apparatus 26 is shown in FIGS. 1 and 2, and the spray apparatus 26 is utilized to spray a foam in a manner and for reasons which will be described in greater detail below. The spray apparatus 26 includes: a water reservoir 28; a pump 30 having an inlet which is connected to the water reservoir 28 by way of a conduit 32 and an outlet which is connected to a proportioner 34 by way of a conduit 36; a foam concentrate tank 38 which is connected to the proportioner 34 by way of a conduit 40; and a nozzle 42 which is connected to the proportioner 34 by way of a conduit 44. Two different nozzles are utilized in practicing the method of the present invention, one of the nozzles being shown in FIG. 1 and designated therein by the reference numeral 42*a* and the other nozzle being shown in FIG. 2 and designated therein by the reference numeral 42*b*.

The water reservoir 28 is adapted to retain a supply of water and the foam concentrate tank 38 is adapted to retain a supply of foam concentrate. The pump 30 is connected to the water reservoir 28 and adapted to pump water from the water reservoir 28 through the conduit 32, the water pumped from the water reservoir 28 being discharged from the pump 30 through the conduit 36. The pump 30 pumps the water into and through the proportioner 34. The water being pumped through the proportioner 34 causes foam concentrate from the foam concentrate tank 38 to be passed out of the foam concentrate tank 38, through the conduit 40 and into the proportioner 34. The water and the foam concentrate are mixed in the proportioner 34 and the water-foam concentrate mixture is passed from the proportioner 34, through the conduit 44 to the nozzle 42 (nozzle 42*a* or 42*b*). The mixture is transformed into foam by agitation and combination with air in the nozzle 42. The foam then is ejected or passed from the nozzle 42 (nozzle 42*a* or 42*b*), as diagrammatically shown in FIGS. 1 and 2.

The nozzle 42*a* is constructed and adapted to foam and expand the received mixture and to discharge the foam therefrom. The nozzle 42*b* also is constructed and adapted to foam and expand the received mixture and to discharge the foam therefrom, in a manner like the nozzle 42*a*. However, the nozzle 42*a* has a lower expansion ratio as compared with the expansion ratio of the nozzle 42*b*, so the foam discharged from the nozzle 42*a* is denser and more viscous than the foam discharged from the nozzle 42*b*. The nozzle 42*a* is utilized to spray foam on the sides 14 and 16 of the wall structures 10 and, since the wall structures 10 are vertically disposed, the denser and more viscous nature of the foam being discharged from the nozzle 42*a* aids in retaining the foam in place on the sides 14 and 16 of the wall structures 10, during the dismantling of the wall structures 10. Nozzles of the type just described with respect to the nozzles 42*a* and 42*b* are commercially available and, thus, a detailed description of the construction and operation of such nozzles is not deemed necessary herein.

Utilizing the method of the present invention, the building is dismantled to the point where substantially only the wall structures 10 remain standing, as shown in FIGS. 1 and 2, such dismantled portions being removed to a remote location with respect to the still standing wall structures 10. The inner walls 16 may be painted to affix any removable radioactivity that may be thereon. The openings in the wall structures 10 substantially are closed by such means as installing panels substantially over such openings, such as the wall panels 22 and 24 which substantially cover the door and window openings 18 and 20, respectively.

The spray apparatus 26, then, is assembled, as shown in FIGS. 1 and 2, with the nozzle 42*a* being connected to one end of the conduit 44. The pump 30 is started and pumps water from the water reservoir 28 and through the proportioner 34. The water passing through the proportioner 34 aspirates the foam concentrate from the foam concentrate tank 38 through the conduit 40 and through the proportioner 34. The mixture of foam concentrate and water passes from the proportioner 34 to the nozzle 42*a*.

The nozzle 42*a* is directed and positioned to spray the foam being discharged therefrom on the sides 14 and 16 of the wall structures 10. As shown in FIG. 1, the nozzle 42*a* is directed and positioned to spray the discharged foam on the side 14*b* of the wall structure 10, for example.

After the foam has been sprayed on the sides 14 and 16, the openings in the wall structures 10 substantially are closed by such means as installing panels substantially over such openings, such as the wall panels 22 and 24 which substantially cover the door and window openings 18 and 20, respectively. The nozzle 42*a* is removed from the conduit 44 and the nozzle 42*b* is connected to the conduit 44, the nozzle 42*b* being shown connected to the conduit 44 in FIG. 2. Following the method of the present invention, the nozzle 42*b* is utilized to provide a reservoir of foam for receiving dismantled portions of the wall structures 10, during the dismantling of the wall structures 10, as diagrammatically illustrated in FIGS. 2 and 3. The particular manner of providing the reservoir of foam depends to some extent on the geometric configuration of the standing wall structures and the general area where it, initially, is determined that the dismantled portions of the wall structures 10 should be directed.

In the example illustrated in FIGS. 1 and 2, it is predetermined to direct the dismantled wall structures 10 generally inwardly toward the space 12. The wall structures 10 are interconnected substantially to enclose the space 12 and, thus, portions of the wall structure 10 can be utilized to retain the foam within a portion of the space 12, the wall structures 10 cooperating to provide the reservoir of foam in this example. Thus, the nozzle 42*b* is positioned to spray the foam being discharged therefrom into the space 12, as diagrammatically illustrated in FIG. 2. The water is pumped from the water reservoir 28 and the foam concentrate is aspirated from the foam concentrate tank 38 in a manner exactly like that described before with respect to spraying the sides 14 and 16.

The foam is discharged into the space 12 until the foam within the space 12 has reached a depth 46 (shown in FIG. 2), the foam in the space 12 providing the reservoir of foam and portions of the wall structures 10 cooperating to retain the foam within the reservoir of the foam. The depth 46 is predetermined so that a predetermined volume of foam is disposed within the reservoir of foam. The particular volume of foam within the foam reservoir should be sufficient to catch the dismantled portions of the wall structures 10 during the dismantling process; however, the volume of foam within the reservoir of foam does not have to cover the dismantled portions of the wall structures 10 discharged therein during the dismantling process. The volume of foam within the foam reservoir should be sufficient to encompass a substantial portion of the dismantled wall structure 10 portions discharged therein, at least to an extent necessary to maintain the level of particles which become airborne during the dismantling process at a predetermined minimum.

Figure 3:
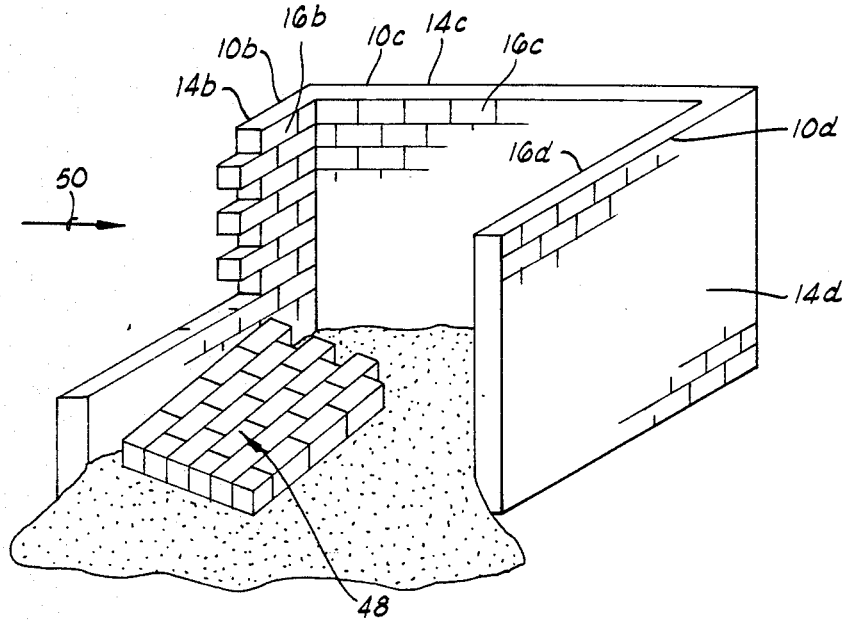
FIG. 3 is a diagrammatic view of the wall structures of FIGS. 1 and 2, but showing one wall structure being dismantled.

After the reservoir of foam has been provided, the dismantling of the wall structures 10 can be initiated. As mentioned before, there are various ways of accomplishing the actual dismantling of the wall structures 10, such as by engaging the wall structures 10 with a mechanical device, the various techniques and devices for accomplishing such dismantling being well known in the art. As shown in FIG. 3, the wall structure 10*a* has been dismantled and a portion of the wall structure 10*b* has been engaged with a mechanical device causing a portion (designated by the reference numeral 48) of the wall structure 10*b* to be dismantled or dislodged from the wall structure 10*b*. In particular, the mechanical device engaged the wall structure 10*b* and placed a force on the wall structure 10*b* in a general direction 50 resulting in dislodging the portion 48 from the wall structure 10*b*. The force is placed on the wall structure 10*b* in such a manner and in such a direction that dismantled portions resulting from the application of such force will be directed toward and into the reservoir of foam. Thus, the dismantled portion 48 of the wall structure 10*b* is shown in FIG. 3 falling into the reservoir of foam.

The remaining portion of the wall structure 10*b* is dismantled and the wall structures 10*c* and 10*d* are dismantled. In each instance, the dismantled portions of the wall structures 10 are directed into the reservoir of foam.

The sides 14 and 16 of the wall structures 10 are covered with foam prior to dismantling the wall structures 10, as described before. The covering of the sides 14 and 16 with foam acts to reduce the amount of dust particles which become airborne during the dismantling of the wall structures 10. However, as the wall structures 10 are dismantled, portions of the wall structure 10 which have not been covered with foam become exposed. The reservoir of foam receives the dismantled portions of the wall structures 10 and the foam tends to surround or encompass the dismantled portions of the wall structures 10, as such portions are disposed in the reservoir of foam. Thus, the reservoir of foam cooperates with the foam previously sprayed on the sides 14 and 16 to maintain the dust particles which become airborne during the dismantling at relatively low levels.

As the wall structures 10 are dismantled, the dismantled wall structures 10, of course, do not function to retain the foam within the reservoir of foam. For example, the dismantled wall structure 10*a* does not retain the foam within the reservoir of foam and, thus, some of the foam from the reservoir of foam moves through the opening provided by the removed or dismantled wall portion 1O*a*, as shown in FIG. 3. It has been found that the removal of the supporting structures (portions of the wall structures 10) for the reservoir of foam results only in minor and relatively slow movement of the foam through the opening thus provided. A portion of the foam from the reservoir of foam is shown in FIG. 3 after it has moved through the opening provided by the removal of the wall structure 10*a*. The volume of foam to be retained within the reservoir of foam should be determined considering this movement of foam through the openings provided by removed or dismantled wall structures 10.

After the wall structures 10 have been dismantled, the foam is allowed to dissipate. Then, the dismantled segments are removed or, otherwise, disposed of in a manner desired in a particular application.

Figure 4:
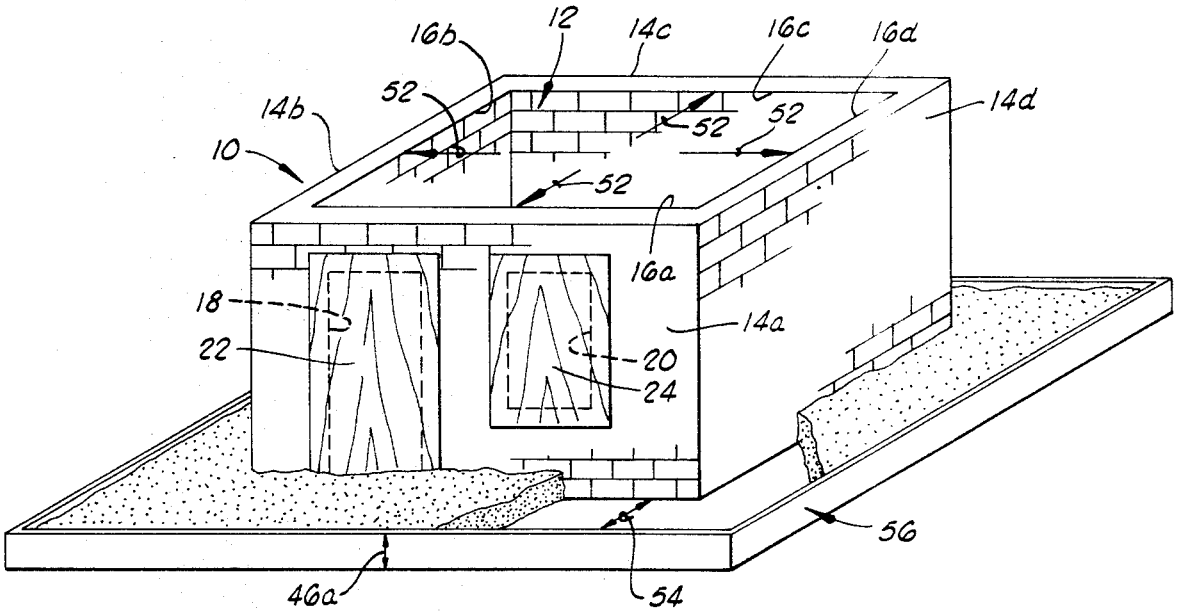
FIG. 4 is a view of wall structures, similar to the wall structures shown in FIGS. 1, 2 and 3, and showing an alternative embodiment for providing the reservoir of foam in accordance with the method of the present invention.

Shown in FIG. 4 is an alternate view of providing the reservoir of foam. In this example, it is predetermined to engage the wall structures 10*a* with a force in the general outwardly direction 52, thereby causing dismantled or dislodged portions of the wall structures 10 to fall or be directed outwardly. Thus, the reservoir of foam is provided on the outside of the wall structures 10, the reservoir of foam extending about the periphery formed by the sides 14 of the wall structures 10 and spaced a distance 54 from the sides 14.

As shown in FIG. 4, a reservoir wall 56 is constructed. The reservoir wall 56 is spaced the distance 54 from the side 14 of each of the wall structures 10, the reservoir wall 56 extending peripherally about the wall structure 10. The reservoir wall 56 has a depth 46*a* which is sized in a manner like that described before with respect to the depth 46 so the reservoir of foam contains a predetermined volume of foam.

In the embodiment shown in FIG. 4, the sides 14 and 16, initially, are coated with foam, the foam being sprayed on the sides 14 and 16 in a manner exactly like that described before with respect to FIG. 1. The nozzle 42*a*, then, is removed and the nozzle 42*b* is connected to the conduit 44. Utilizing the nozzle 42*b*, the foam is sprayed into the space between the reservoir wall 56 and the sides 14 of the wall structures 10 until this space substantially is filled with foam. The reservoir wall 56 cooperates with portions of the sides 14 of the wall structures 10 to retain the foam within the space between the reservoir wall 56 and the sides 14 of the wall structures 10, such foam providing the reservoir of foam. After the reservoir of foam has been provided, the wall structures 10 are dismantled in a manner similar to that described before, except the forces are applied in the directions 52 to direct the dislodged or dismantled portions of the wall structures 10 toward and into the reservoir of foam.

In one example, the method of the present invention specifically was employed to dismantle a building which was contaminated by way of exposure to radioactive materials. These wall structures contained both fixed and removable contaminats, such as thorium-natural (Th-232 and daughter products) emitting alpha particles. Direct alpha particle measurements of internal segments of the building were from about $1\times106^6$ to about $1\times10^7$ dpm/m$^2$, with approximately 0.5% to 20% of this being removable by usual washing procedures. The building, after removal of the roof, plumbing and ductwork, was painted to fix accessible removable radioactivity. The particular foam utilized was a detergent expansion foam commercially available under the trade name Ultrafoam Concentrate from such sources as Mine Safety Appliances Company of Pittsburgh, Pa. This particular foam concentrate basically is an alkyl sulfate which contains a small amount of an aliphatic alcohol. When diluted for use, this type of foam is biodegradeable.

A nozzle of the type available from Feecon Corporation of Westboro, Mass., and referred to as Model PV-95 was found satisfactory for use as the nozzle 42*a* for spraying the sides of the wall structures. With this type of nozzle, the ratio of foam concentrate and water passing through the nozzle was a maximum of about thirty parts water to one part foam concentrate. The foam discharged from the nozzle had an expanded density of approximately 2.03 pounds per cubic foot.

A nozzle of the type available from Fire and Safety Equipment, Inc., of Chicago, Ill., and referred to as Model KR4-75 was found satisfactory for use as the nozzle 42*b* for spraying foam into the foam reservoir. With this type of nozzle, the ratio of foam concentrate to water was a maximum of about seventy-five parts water to one part foam concentrate. The foam discharged from the nozzle had an expanded density of approximately 0.83 pounds per cubic foot.

In this example, the wall structures generally were rectangularly shaped, similar to the wall structures 10 shown in FIG. 1. The wall structures connected in the rectangular shape had a width of about thirty feet, a length of about fifty-two and one-half feet and a height of about ten feet. The sides of the wall structures were sprayed with foam in the manner described in connection with FIG. 1. The reservoir of foam was formed within the space enclosed by the wall structures in the manner described in connection with FIG. 2, and, in this instance, the reservoir of foam had a depth of foam of about four feet.

After the sides of the wall structures were sprayed with foam and the reservoir of foam has been provided, the wall structures were dismantled utilizing mechanical devices to apply the necessary forces to the wall structures. More particularly, a device commonly known as a front end loader was utilized to dismantle some portions of the wall structures and a backhoe type of device was utilized to dismantle some other portions of the wall structures, although the backhoe was not found to be as effective as the front end loader in dismantling large areas of the wall structures in this particular example.

Prior to, during and subsequent to the dismantling of these wall structures, air samplers of the filtration type were set up at various locations in proximity to and within about one block or one hundred yards of the radioactively contaminated wall structure to be dismantled. A first air sampler, perhaps the most pertinent, was located downwind of the wall structure during its dismantling. The first air sampler was set to pass twenty to twenty-five liters of air per minute through a packed glass fiber filter. This type of filter is well known in the art and captures nearly one hundred percent of all particles suspended in air passing therethrough. The first sampler generally was run for daily periods of one to two hours and for the entire time the building was being dismantled. The glass fiber filter was removed after each filtration period. At least four days after each glass fiber filter was removed, it was assayed for captured long lived radioactivity by emplacement in an instrument capable of determining the gross alpha activity on the filter.

Figure 5:
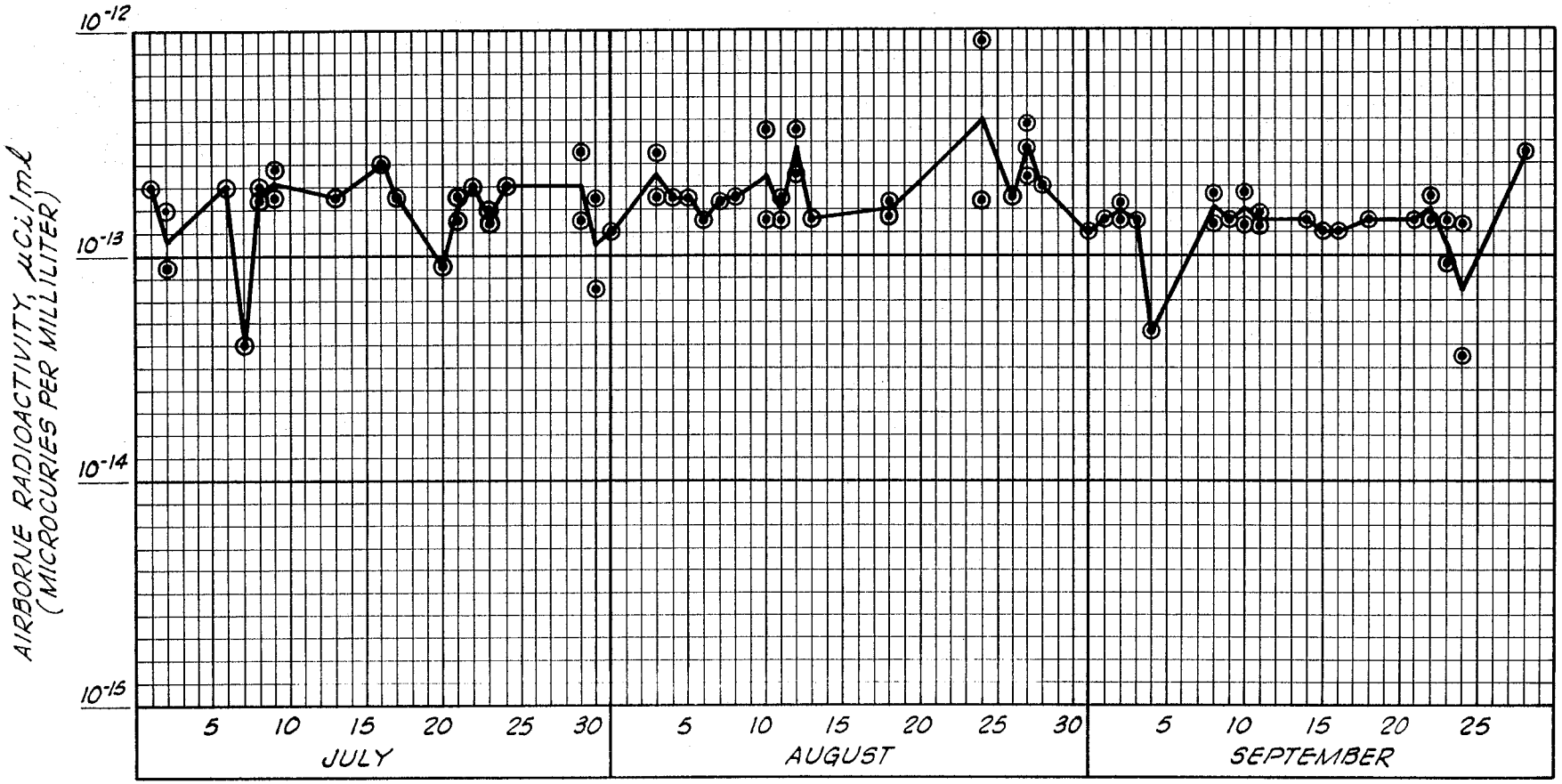
FIG. 5 is a graph showing the airborne radioactivity concentration downwind of treated and dismantled radioactively contaminated wall structures, the long-lived airborne concentration, $\mu$Ci/ml (microcuries per milliliter) being plotted versus time.

The alpha particles emitted from each of the glass fiber filters were used to determine the airborne concentrations, reported as microcuries per milliliter of air filtered ($\mu$Ci/ml), are indicated in FIG. 5 as a function of the date the air filtration sample was taken. The contaminated wall structures were dismantled on Aug. 28. As shown in FIG. 5, the radioactivity of the air downwind from the wall structures did not increase during this dismantling. After the wall structures were dismantled, the foam was allowed to dissipate by drying and the dismantled wall sections were removed for proper disposal. As shown in FIG. 5, this removal process, occurring from about Aug. 10, 1981, to about Oct. 1, 1981, also resulted in no increase of airborne radioactivity.

Although it is preferred to spray foam on the sides of the wall structures and to provide the reservoir of foam for receiving dismantled portions of the wall structures in the manner described before, the method of the present invention could be effected by omitting either the step of spraying the foam on the sides of the wall structures or the step of providing the reservoir of foam. In either of these last mentioned embodiments, the amount of particles which become airborne during the dismantling of the wall structures would be reduced as compared with prior methods of dismantling.

The method of the present invention also is utilized in dismantling such structures as foundations of a building, for example. In addition, the method of the present invention is utilized to reduce the amount of particles which become airborne during the moving of the debris remaining after such dismantling of wall structures or foundation structures. Also, the method of the present invention is useful in moving debris, regardless of how the debris came into existence, the debris being the structure in this last-mentioned instance. Thus, the method of the present invention is utilized for reducing the amount of particles which become airborne during either or both the dismantling and moving of structures.

Also, it should be noted that additional foam may be sprayed either on the wall structures or the resulting debris or both as the wall structures are dismantled further to assure control of particles which become airborne. In addition, the spray apparatus 26 may be modified so both spray nozzles 42*a* and 42*b* could be used simultaneously.

Changes may be made in the apparatus or in components thereof and changes may be made in the steps or the sequence of the steps of the method disclosed herein without departing from the spirit and the scope of the invention as defined in the claims.

What is claimed is:

1. A method for reducing the amount of particles which become airborne during the dismantling of wall structures comprising the steps of:

providing a reservoir for receiving a dissipative foam by constructing a reservoir wall spaced a distance from the wall structures, the reservoir wall cooperating with a portion of the wall structures to define the reservoir and retain the foam;

spraying said foam into the reservoir to provide a reservoir of foam;

spraying a dissipative foam on the wall structures to be dismantled; and dismantling portions of said wall structures and directing substantially all of the dismantled portions of the wall structures into the reservoir of foam until the wall structures substantially are dismantled.

2. The method of claim 1 wherein the step of providing the reservoir is defined further as providing a reservoir having a predetermined volume adequate to accommodate a predetermined volume of said foam sufficient to receive the dismantled portions of the wall structures, and the step of spraying the foam into the reservoir is defined further as spraying the predetermined volume of foam into the reservoir.

3. The method of claim 1 wherein the step of spraying the foam on the wall structures is defined further as spraying the foam on the sides of the wall structures.

4. The method of claim 3 wherein the step of spraying the foam on the sides of the wall structures is defined further to include the steps of:

providing water;

providing foam concentrate;

mixing the water and foam concentrate; and expanding the mixed water and foam concentrate to provide the foam having a predetermined density sufficient to facilitate the foam substantially remaining in place on the sides of the wall structures during the dismantling of the wall structures.

5. The method of claim 4 wherein the step of spraying the foam into the reservoir is defined further to include the steps of:

providing water;

providing foam concentrate;

mixing the water and foam concentrate; and expanding the mixed water and foam concentrate to provide the foam having a predetermined density, the density of the foam providing the reservoir of foam being less than the density of the foam sprayed on the sides of the wall structures.

6. The method of claim 1 wherein the wall structures are defined further as being contaminated by way of exposure to radioactive materials.

7. The method of claim 1 defined further to include the steps of:

permitting the foam to dissipate after dismantling the wall structures; and disposing of the dismantled wall structures.

8. A method for reducing the amount of particles which become airborne during the dismantling of wall structures comprising the steps of:

providing a reservoir for receiving a dissipative foam by constructing a reservoir wall spaced a distance from the wall structures, the reservoir wall cooperating with a portion of the wall structures to define the reservoir and retain the foam;

spraying said foam into the reservoir to provide a reservoir of foam; and dismantling portions of said wall structures and directing substantially all of the dismantled portions of the wall structures into the reservoir of foam until the wall structures substantially are dismantled.

9. The method of claim 8 wherein the step of providing the reservoir is defined further as providing a reservoir having a predetermined volume adequate to accommodate a predetermined volume of the foam sufficient to receive the dismantled portions of the wall structures and wherein the step of spraying the foam into the reservoir is defined further as spraying the predetermined volume of foam into the reservoir.

10. The method of claim 8 wherein the wall structures are defined further as being contaminated by way of exposure to radioactive materials.

11. The method of claim 8 defined further to include the steps of:

permitting the foam to dissipate after dismantling the wall structures; and disposing of the dismantled wall structures.

* * * * *